US006695186B2

(12) United States Patent
Madarang

(10) Patent No.: US 6,695,186 B2
(45) **Date of Patent: *Feb. 24, 2004**

(54) FULLY CONCEALED FAST-DRAW HOLSTER

(76) Inventor: Alfredo Madarang, 324 F. Ramos Street, Cebu City, Cebu, 6000 (PH)

( * ) Notice: Subject to any disclaimer, the term of this patent is extended or adjusted under 35 U.S.C. 154(b) by 0 days.

This patent is subject to a terminal disclaimer.

(21) Appl. No.: 10/124,748

(22) Filed: Apr. 16, 2002

(65) Prior Publication Data

US 2002/0139825 A1 Oct. 3, 2002

Related U.S. Application Data

(63) Continuation-in-part of application No. 09/648,976, filed on Aug. 28, 2000, now Pat. No. 6,402,001.

(51) Int. Cl.[7] ..... A45C 1/04

(52) U.S. Cl. ..... 224/587; 224/191; 224/192; 224/193; 224/198; 224/911; 224/912

(58) Field of Search ..... 224/587, 191, 224/192, 193, 198, 911, 912

*Primary Examiner*—Lee Young
*Assistant Examiner*—Maerena W. Brevard
(74) *Attorney, Agent, or Firm*—Law Office of Royal W. Craig

(57) ABSTRACT

An improved concealed holster, for use by either right- or left-handed wearers, comprises a holster bracket worn at the abdomen and having a pair of laterally-spaced spacer flanges joined by an arcuate panel generally conforming to the curve of the body. A pistol seat protrudes inward from the arcuate panel for seating a pistol thereon within the confines of the flanges, panel and the user's body. The holster is intended to be worn under the trousers at the abdomen and the pistol is easily dislodged by pressing up on its barrel with one hand, and then quick-drawn with the other hand. The improved holster does not compromise between accessibility and full-concealment, permitting instant accessibility to facilitate a quick-draw. Both holster and pistol can be worn comfortably and securely over a prolong period of time. Moreover, the device can easily and economically be made using a variety of economical manufacturing processes (molding, metal stamping, etc.) using a variety of alternative economical materials (plastic, metal, leather, etc.).

5 Claims, 12 Drawing Sheets

FULLY CONCEALED FAST-DRAW HOLSTER

CROSS-REFERENCE TO RELATED APPLICATIONS

The present application is a continuation-in-part of U.S. application Ser. No. 09/648,976, filed Aug. 28, 2000, now U.S. Pat No. 6,402,001 which in turn derives priority from Philippine Patent Applications Nos. 1-1999-03148 filed Dec. 14, 1999, and 1-2000-00008 filed Jan. 4, 2000.

BACKGROUND OF THE INVENTION

1. Field of the Invention

The present invention relates to pistol holsters and, more particularly, to a covert holster for complete concealment of a pistol and for quick-draw accessibility of the pistol.

2. Description of the Background

Many holsters and harnesses strive for ready accessibility of the weapon that they carry. Unfortunately, they often sacrifice subtlety in the process. There are many instances, such as in civilian clothed security personnel or civilian carrying of weapons, undercover police personnel and the like, where it is desirable to conceal and disguise the presence of a pistol by use of a concealed holster. Traditional holsters and harnesses, concealed or visible, have often been bulky, uncomfortable to wear, expensive to produce and difficult to conceal.

For example, U.S. Pat. No. 3,720,013 discloses a pistol concealing bag-like holster having the outward appearance of a purse or tobacco pouch. The pistol contained therein can be fired from within the pouch via a trigger finger receiving aperture in one of its sides. In firing the pouch-contained pistol, the high velocity bullet or slug tears out one end of the pouch. Also, the pouch-contained pistol is free to move about in the pouch, there being no means to retain the pistol at a proper firing position within the pouch. Although the weapon is readily accessible, the pouch itself is awkward. Other efforts to improve concealment move the weapon into a shoulder harness worn under the shirt. Unfortunately, the shoulder harness sacrifices accessibility.

It would be greatly advantageous to provide the best of both in an improved covert holster, designed for either right- or left-handed (or ambidextrous) users, capable of full concealment of a pistol, and which permits instant accessibility and comfort of wearing of the pistol over a prolonged period of time.

SUMMARY OF THE INVENTION

It is, therefore, an object of the present invention to provide an improved holster capable of full concealment beneath the trousers at the abdomen.

It is another object to provide an improved holster which does not compromise between accessibility and full-concealment, permitting instant accessibility to facilitate a quick-draw.

Still another object is to provide an improved fully-concealed quick-draw holster as described above that can be worn with a pistol both comfortably and securely over a prolonged period of time.

It is yet another object to provide an improved fully-concealed quick-draw holster as described above that can be utilized with equal effectiveness by right-handed and left-handed users.

It is another object of the present invention to provide an improved fully-concealed quick-draw holster as described above that lends itself to a variety of economical manufacturing processes using a variety of alternative economical materials.

In accordance with the above objects, one embodiment of an improved concealed holster comprises a holster bracket worn at the abdomen and having a pair of laterally-spaced spacer flanges joined by an arcuate panel generally conforming to the curve of the body. A pistol seat protrudes inwardly from the arcuate panel for seating a pistol thereon within the confines of the flanges, panel and the user's body. The holster is intended to be worn under the trousers at the abdomen such that the pistol is easily dislodged by pressing up on its barrel with one hand, and then quick-drawn with the other hand, regardless of which hand is to be used for the various steps in the process. The pistol seat is a horizontal member extending to a perpendicular retainer for capturing the pistol by its butt. A second embodiment is also described in which the pistol seat and retainer are replaced by a pistol seating strap, extending inwardly between opposing points of the arcuate panel, for harnessing the pistol therein.

BRIEF DESCRIPTION OF THE DRAWINGS

Other objects, features, and advantages of the present invention will become more apparent from the following detailed description of the preferred embodiments and modifications thereof when taken together with the accompanying drawings in which.

DETAILED DESCRIPTION OF THE PREFERRED EMBODIMENTS

Figure 1:
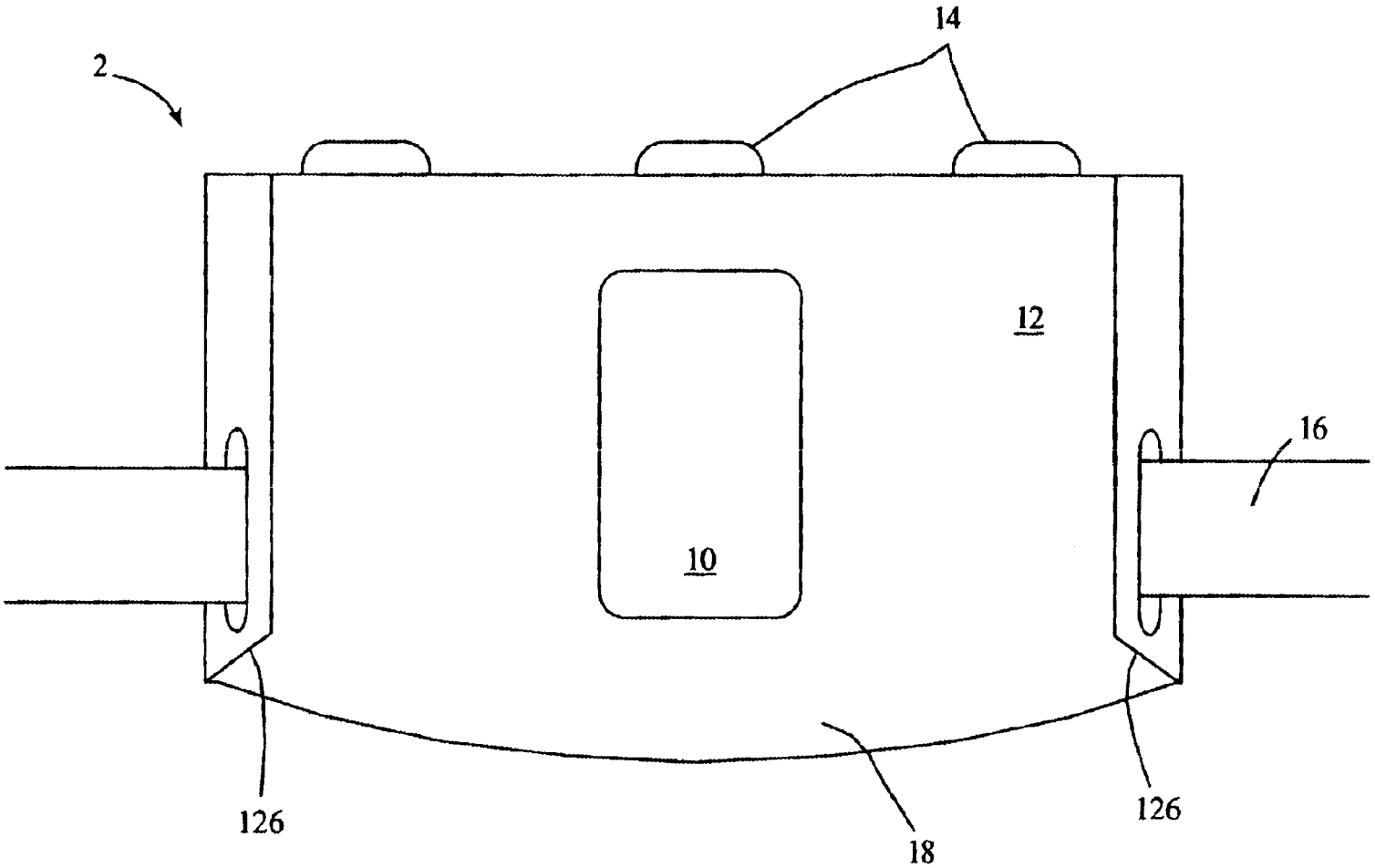
FIG. 1 is a rear perspective view of the fully concealed fast-draw holster 2 according to one embodiment of the present invention.

FIG. 1 is a rear perspective view of the fully concealed fast-draw holster 2 according to one embodiment of the present invention which is suitable for both right- and left-handed (or ambidextrous) users. The concealed fast-draw holster 2 generally includes a rigid but flexible curved holster bracket 12 formed with opposing spacer flanges 122 (see FIG. 6), a pistol seating clip 10 directed opposite a series of belt clips 14, a waist strap 16 and apron 18.

The curved holster bracket 12 is contoured to fit the curve of the body in the abdominal area of the waist. Opposing spacer flanges 122 project inward from the curved section to form a three-walled compartment against the body when worn. When the holster 2 is worn properly inside the user's trousers and with the side illustrated in FIG. 1 directed against the abdomen, the belt clips 14 project outward and curve downward from the top ridge of the holster bracket 12 for attachment to a conventional trouser belt, thereby assuring that the holster bracket 12 does not sink beneath the waist-line. The waist strap 16 encircles the waist and wraps around the outside of the holster 2 to allow the holster 2 to be secured firmly but comfortably against the body. As such, the pistol seating clip 10 is directed inward toward the abdomen to provide a seat for the pistol 20 (see FIG. 2*a* or 2*b*) inside the three-walled enclosure formed by the curved holster bracket 12 (and flanges 122) against the body. Apron 18 may be formed in various configurations as desired and ensures that the user's trousers lie flat so as not to belie the presence of the weapon. Apron 18 is preferably open at the barrel of the pistol 20 to provide access thereto for reasons that will become apparent.

Figure 2A:
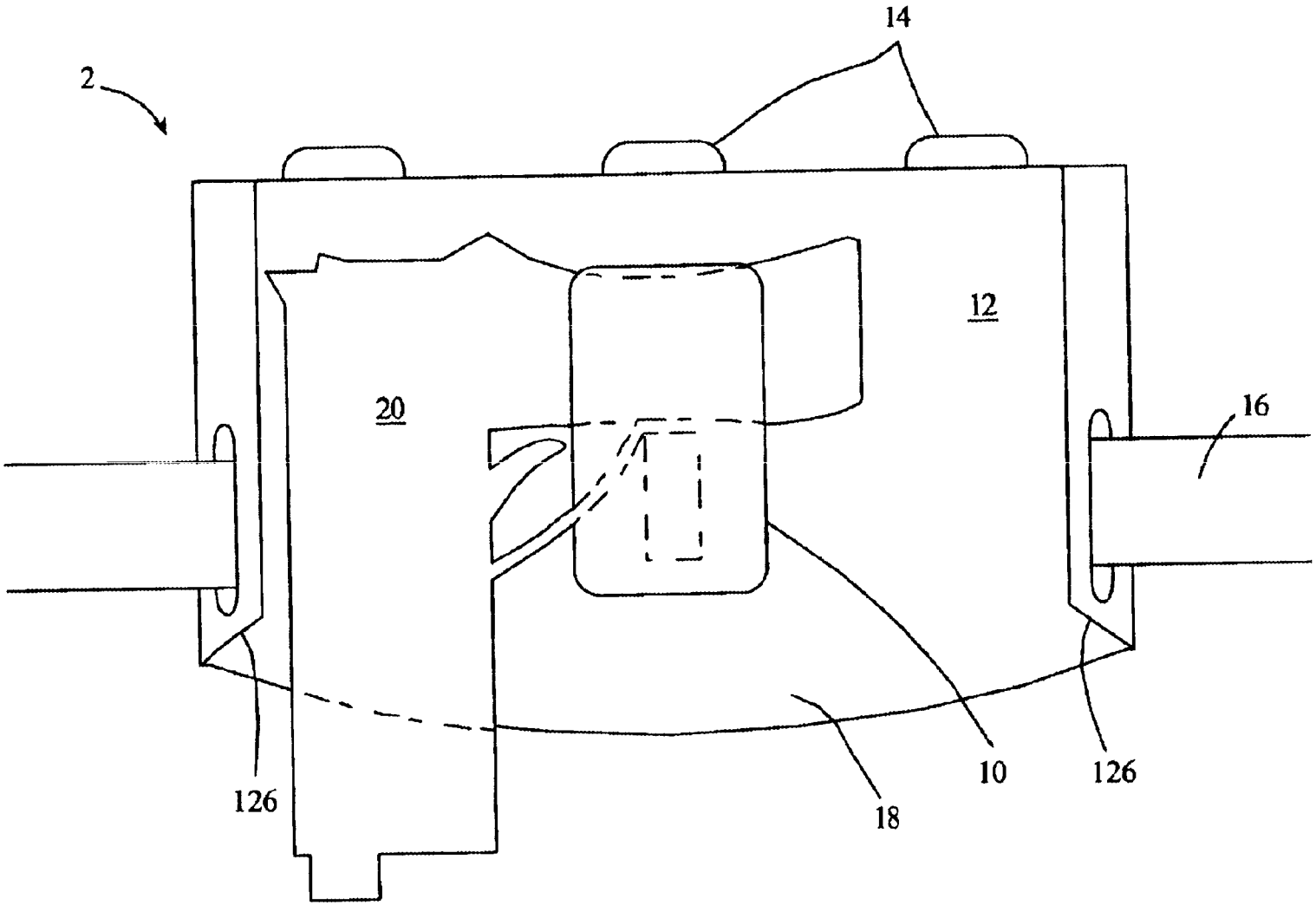
FIG. 2*a* is a rear perspective view illustrating how the pistol 20 sits within the inner compartment 12 when the holster 2 is worn by a right-handed user.
Figure 2B:
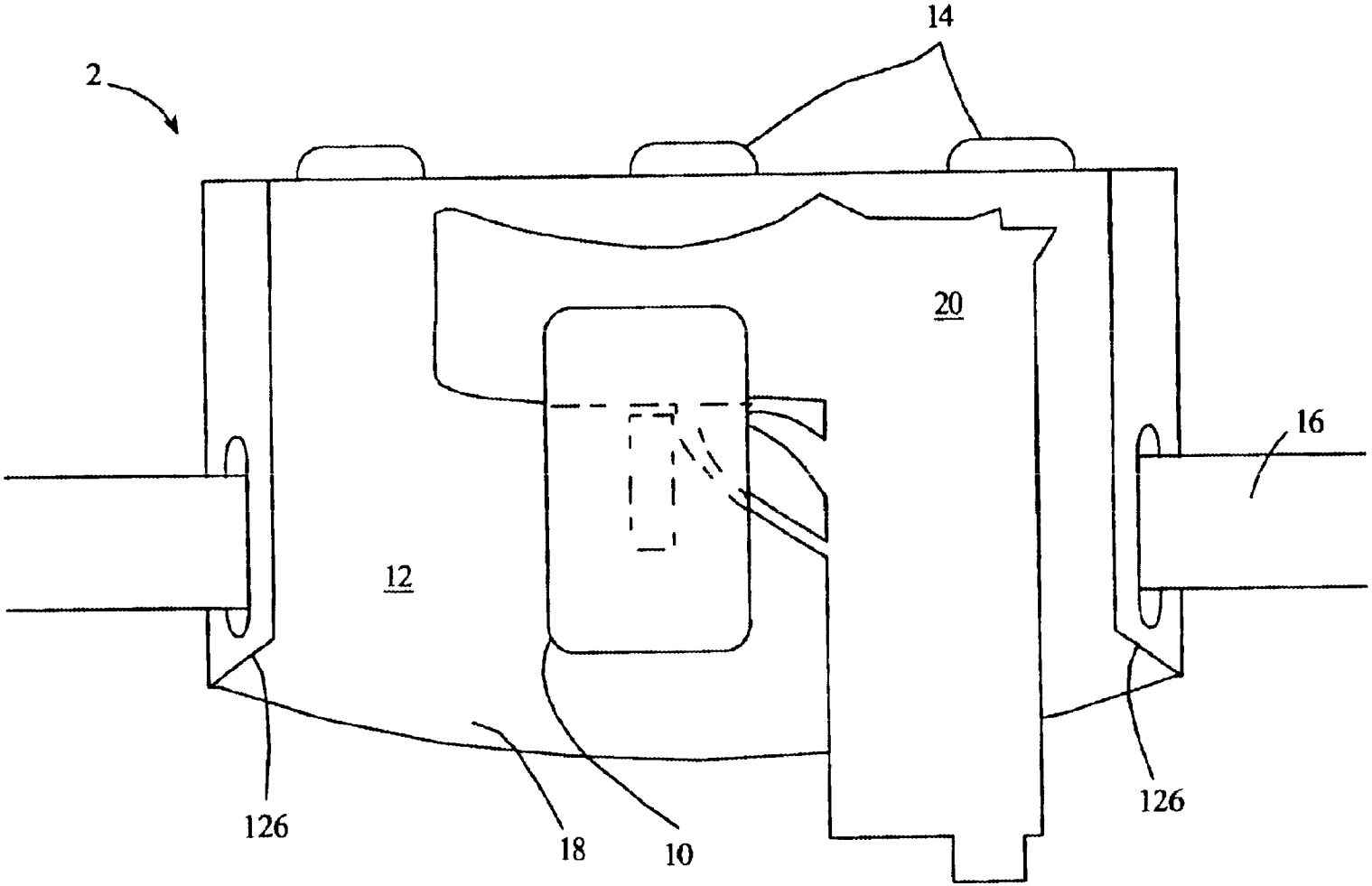
FIG. 2*b* is a rear perspective view illustrating how the pistol 20 sits within the inner compartment 12 when the holster 2 is worn by a left-handed user.

FIGS. 2*a* and 2*b* are rear perspective views of the concealed fast-draw holster 2 of FIG. 1 illustrating how a pistol sits within the inner compartment 12. FIG. 2*a* shows the pistol 20 in the position utilized by a right-handed wearer of the holster 2. FIG. 2*b* shows the pistol 20 in the position utilized by a left-handed wearer of the holster 2. The pistol 20 is inserted downward until the trigger guard comes to rest against the seating clip 10, thereby urging the top of the pistol 20 against the forward spacer flange 122 (see FIGS. 7 and 8). The seating clip 10 captures the pistol 20 by the butt, yet it provides support close to the trigger guard so that the pistol 20 will not fall. The waist strap 16 is attached as shown toward the bottom of the holster bracket 12 to keep it flush against the body (i.e. to avoid forward protrusion of the apron 18). When worn, the holster 2 holds the pistol 20 securely against the abdomen and fully concealed inside the three-walled enclosure formed by curved holster bracket 12 against the body. Despite full concealment, the pistol 20 remains readily accessible and can be drawn instantly and covertly so as not to call attention to the draw.

Apron 18 may be integrally formed/molded with holster bracket 12 or may be separately formed and attached lengthwise in a downwardly extending manner. Again, apron 18 may be formed in various configurations as desired and serves to give a more flush appearance against the trousers of the user. Apron 18 also covers up the pistol handle and avoids accidental pulling of the trigger as the pistol is pushed upward during the draw procedure.

Figure 5:
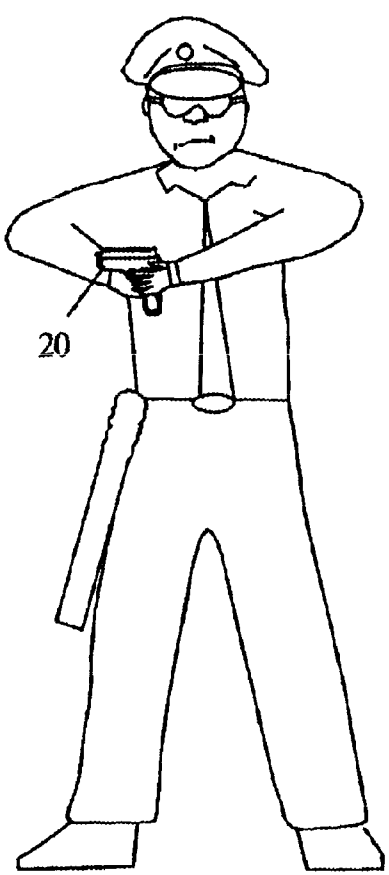
FIGS. 3–5 are sequential perspective views illustrating the technique of a right-handed user for utilizing the concealed fast-draw holster 2 of FIGS. 1 and 2*a*.
Figure 4:
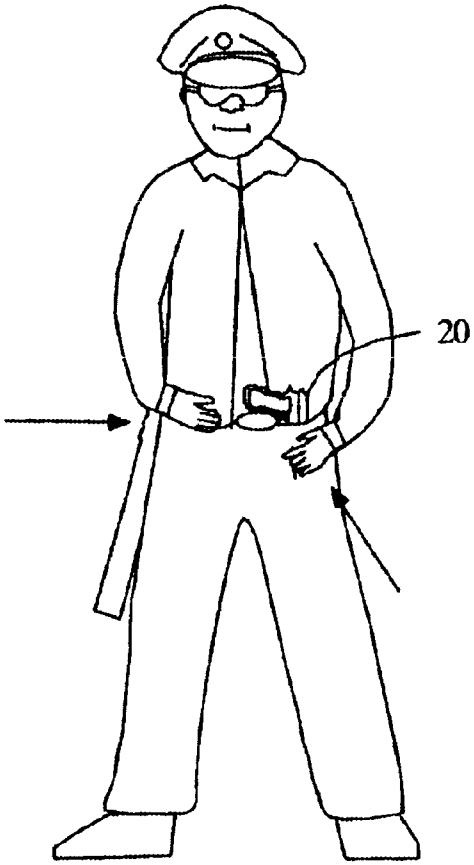
Figure 3:
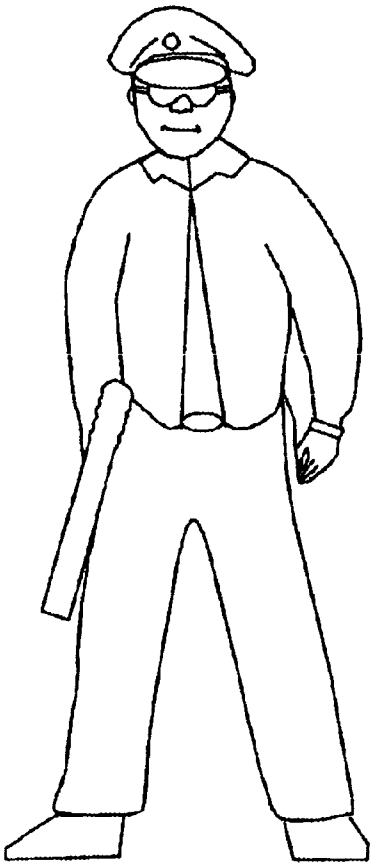

FIGS. 3–5 are sequential perspective views illustrating the technique for using the concealed fast-draw holster 2 and pistol 20 position of FIG. 2*a* (i.e. a right-handed user). As seen in FIG. 3, the pistol 20 and holster 2 remain fully concealed beneath the trousers of the user. When it is desirable to draw the pistol 20, the right-handed user moves his left hand into the vicinity of the barrel of the gun 20 as seen in FIG. 4. This can be done overtly as shown, or covertly with the left hand inserted in the trouser pocket. The user then uses the left hand to press upward against the barrel of the pistol 20. This action serves to eject the pistol 20 outward from the top of the holster 2, thereby elevating the butt of the pistol 20 a few inches above the user's waistline (i.e. fully exposed above the user's belt). As seen in FIG. 5, all that is left is for the user to grasp the butt of the pistol 20 with the right hand and draw. After nominal practice the foregoing draw process becomes substantially instantaneous and very difficult to anticipate.

As is obvious to those skilled in the art, the sequence of steps utilized by a left-handed user wearing the holster 2/pistol 20 configuration of FIG. 2*b* are identical to that described above with the right hand performing the left hand's actions and vice versa.

Figure 6:
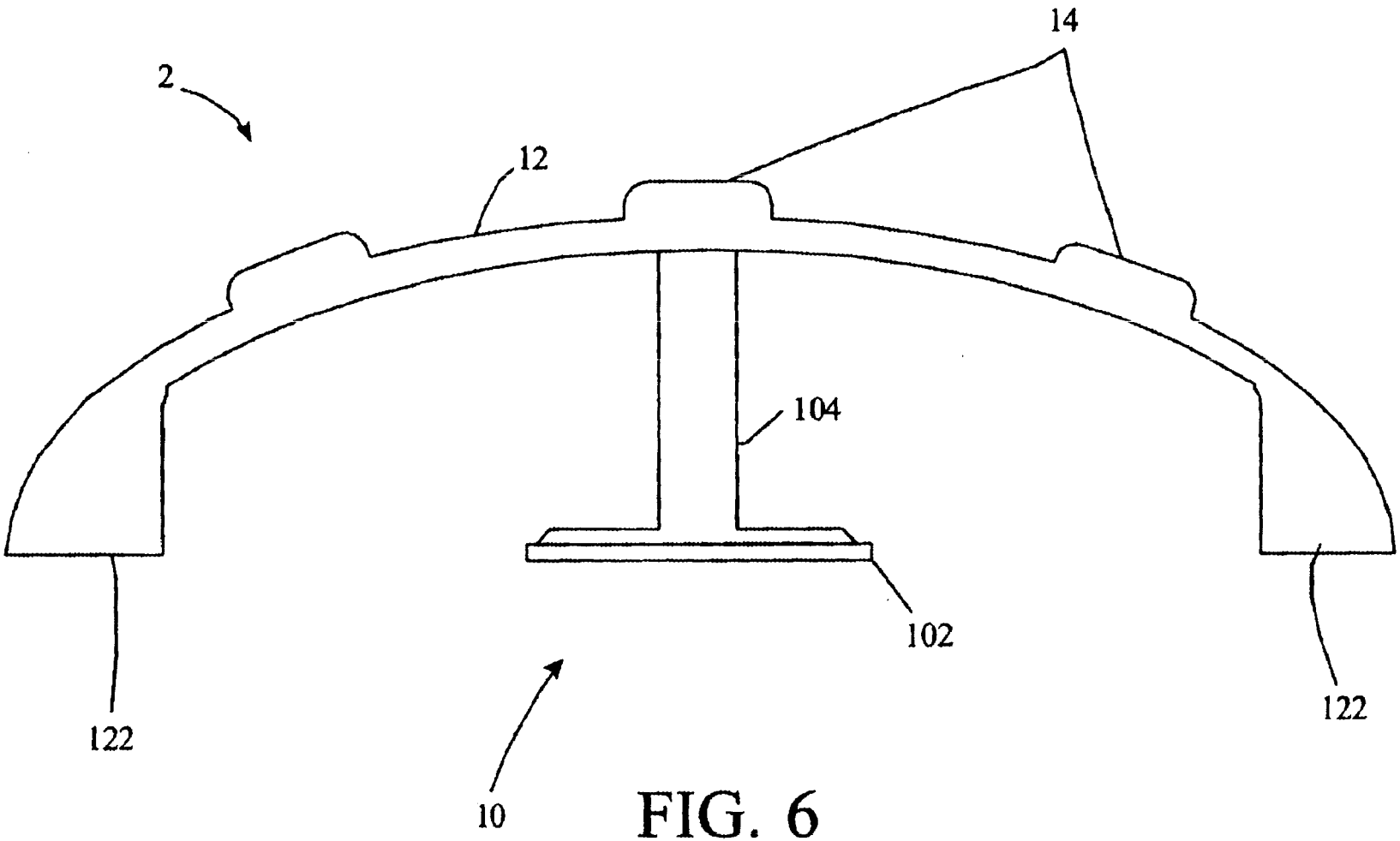
FIG. 6 is a top perspective view of the concealed fast-draw holster 2 of FIGS. 1–2*b*.

FIG. 6 is a top perspective view of the inner compartment formed by the curved holster bracket 12 and opposing spacer flanges 122 of the concealed fast-draw holster 2 of FIGS. 1–5. The curved holster bracket 12 conforms to the contour of the waist and projects outwardly approximately 2½" from the abdomen. The belt clips 14 are curved downwardly and remain substantially flat against the bracket 12. Consequently, the resulting dimensions are much too shallow to cause any noticeable protrusion beneath the user's trousers. The seating clip 10 protrudes into the hollow of the curved holster bracket 12 from the bottom edge. The seating clip 10 includes a retainer 102 that captures the pistol 20 by the butt. The seating clip 10 also includes a seat 104 that contacts the trigger guard of pistol 20. The opposing spacer flanges 122 project directly inward toward the waist at opposing ends of the holster bracket 12, and both are flared outward at the edges (at 90° angles) to insure comfortable contact against the skin of the user. An optional anti-snag guard 126 (see FIGS. 1–2*b*) may be provided to guide insertion and removal of the barrel of pistol 20, and this projects downwardly from the inner lower corner of the holster bracket 12 to prevent snags. Anti-snag guard 126 is a recommended option for formed metal embodiments to avoid sharp edges. In contrast, molded plastic embodiments can be formed with curved edges to avoid snagging. When the pistol being pushed upward and the pistol sight passes through the holster bracket 12, anti-snag guard 126 ensures smooth passage of the pistol sight.

It should be apparent that the entire holster bracket 12 inclusive of seating clip 10, opposing spacer flanges 122, belt clips 14 and anti-snag guard 126 may be economically molded from hard plastic, cut from hardened leather, or alternatively formed from bent sheet metal (such as aluminum sheet) as desired.

Figure 7:
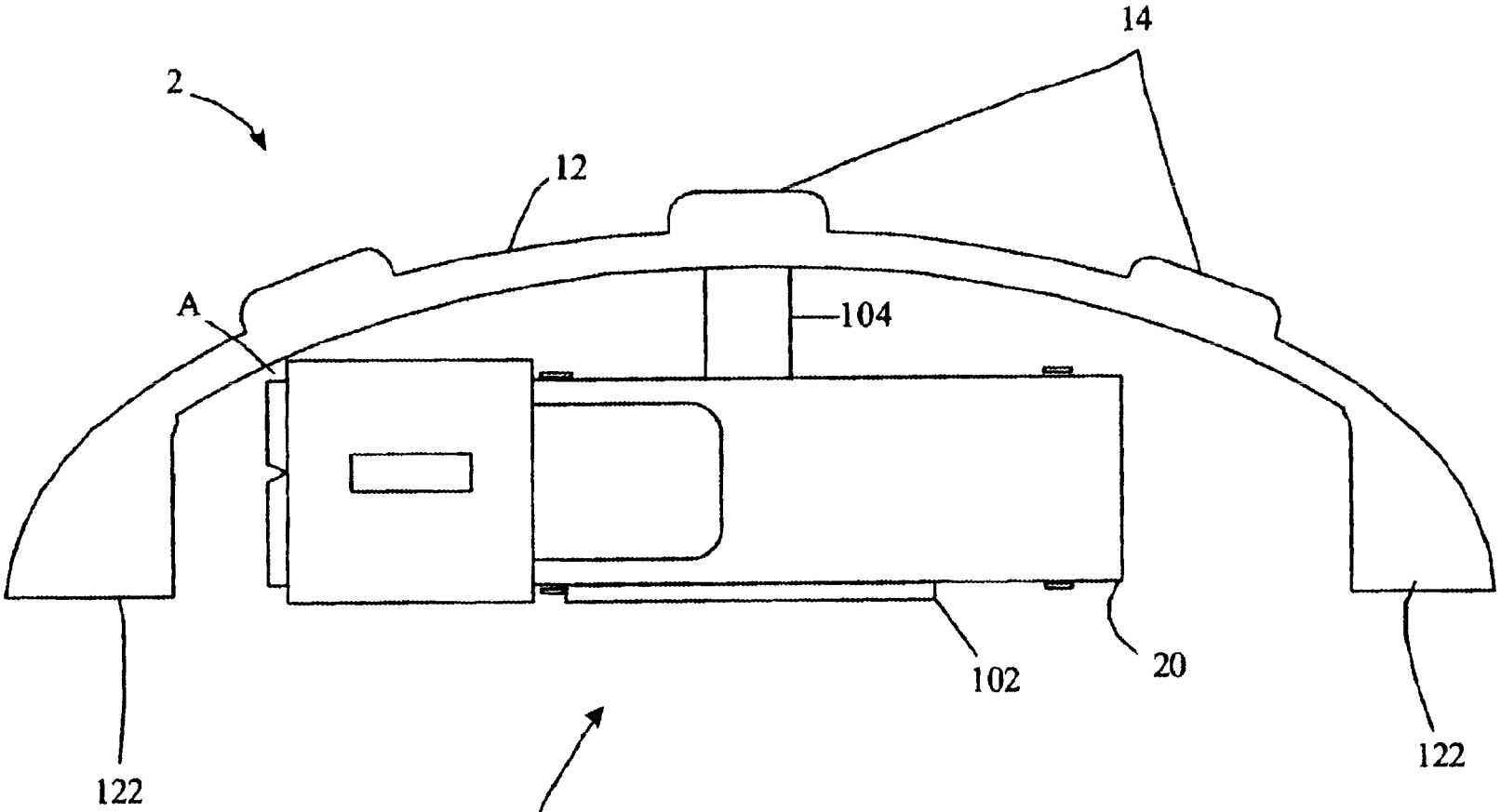
FIG. 7 is a top perspective view of the concealed fast-draw holster 2 of FIGS. 1 and 2*a* illustrating how a pistol sits within the inner compartment 12 when the holster 2 is worn by a right-handed user.
Figure 8:
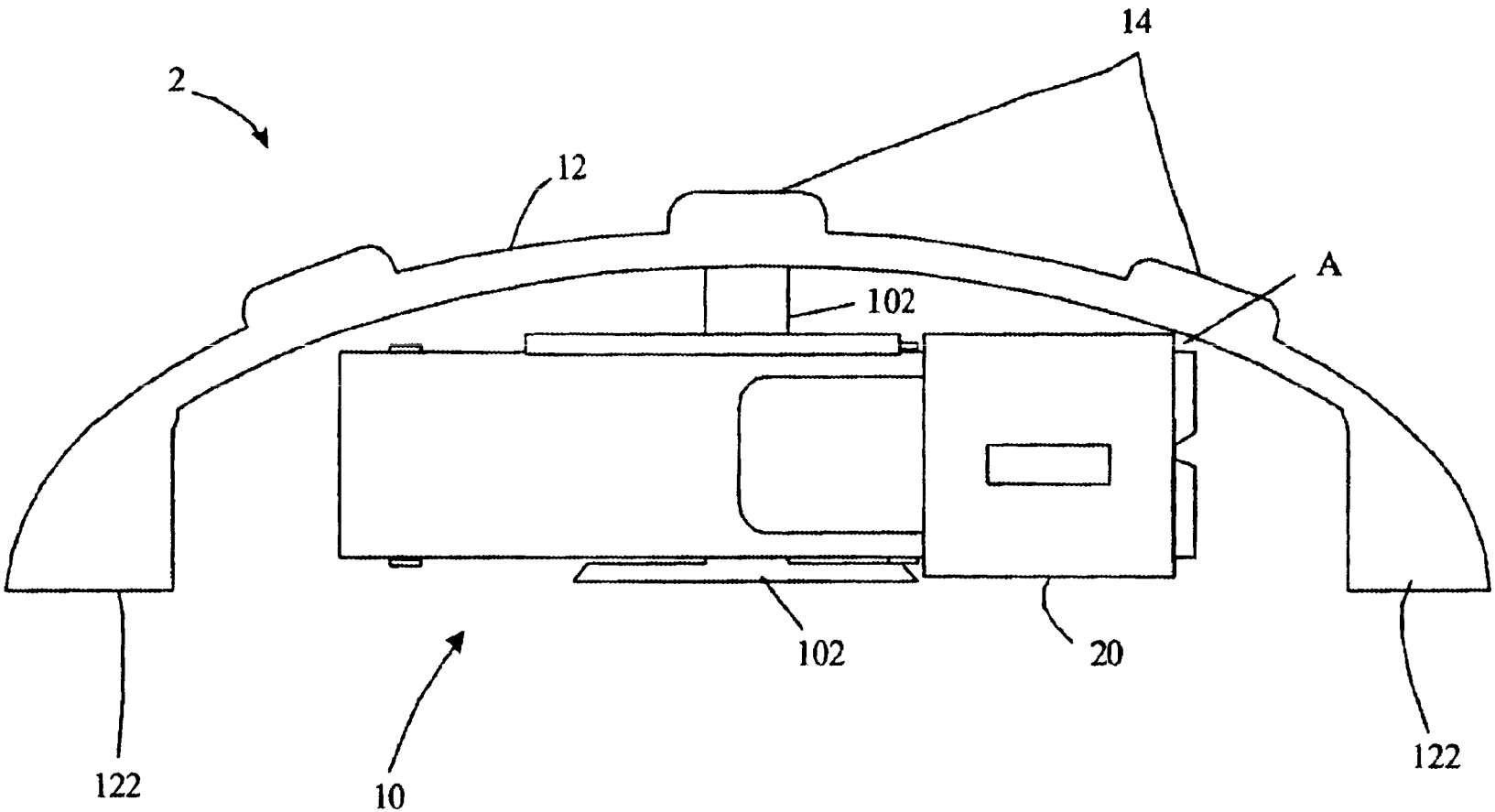
FIG. 8 is a top perspective view of the concealed fast-draw holster 2 of FIGS. 1 and 2*b* illustrating how a pistol sits within the inner compartment 12 when the holster 2 is worn by a left-handed user.

FIGS. 7 and 8 are top perspective views of the concealed fast-draw holster 2 of FIGS. 2*a* and 2*b* illustrating how a pistol 20 sits within the inner compartment of holster bracket 12. Specifically, FIG. 7 shows the holster 2/pistol 20 configuration for a right-handed user while FIG. 8 shows the holster 2/pistol 20 configuration for a left-handed user. The seat 104 protrudes outward approximately 1½" depending on the dimensions of the pistol 20 to be seated, and it attaches, at a 90° angle, to the retainer 102 to catch the butt of the pistol 20 proximate the trigger guard. Preferably, the holster bracket 12, whether formed from metal, plastic or leather, maintains a certain degree of resiliency and will flex inwardly when tightened against the user by the fastening holster bracket strap 16 (see FIG. 1). Thus, the spacing between the butt of the pistol 20 and the inside surface of the holster bracket 12 can be adjusted by tightening the holster bracket strap 16. The bulk of the pistol 20 rotates downwardly around the seat 104 until the rear of the barrel encounters contact point A, as shown against the arc of the curved holster bracket 12. This firmly seats the pistol 20 in the illustrated position and yet keeps the pistol 20 free for upward disengagement. The belt clips 14 extend outward away from the body to downwardly protruding lids for retaining the holster bracket 12 on the waistband of the user's trousers. The retaining holster bracket strap 16 may be discontinuous with ends attached to the sides of the holster bracket 12 or, alternatively, may be continuous and also pass beneath the belt clips 14 inwardly of the user's waistband. Preferably, the user will wear a normal belt around his/her trousers thereby completely masking the belt clips 14 from view. The pistol 20 remains inside the three-walled enclosure formed by holster bracket 12 against the body, and the pressure of holster bracket strap 16 holds the entire assembly flush against the user's abdomen thereby fully concealing the entire assembly. Nevertheless, the pistol 20 is upwardly free and is instantly accessible simply by pushing upward on the barrel of the pistol 20.

Figure 9A:
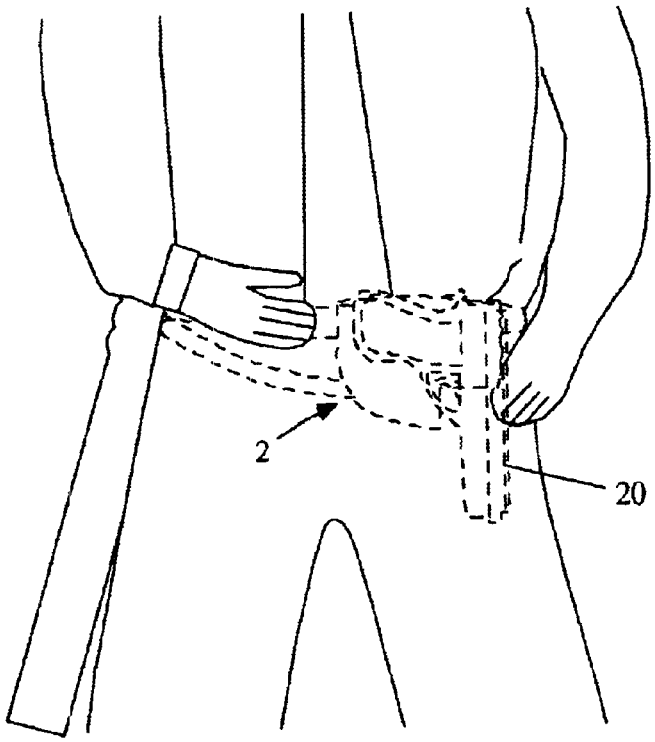
FIGS. 9*a* and 9*b* are close-up front perspective views further illustrating the technique for using the concealed fast-draw holster 2 of FIGS. 1 and 2*a* by a right-handed user.

FIG. 9*a* is a close-up front perspective view further illustrating the technique for using the concealed fast-draw holster 2 of FIGS. 1–2*b*. Just a slight upward pressure to the tip of the barrel of pistol 20 with the left hand (assuming a right-handed wearer as in FIG. 2*a*) dislodges the pistol 20 and elevates the butt above the user's waistband and belt for an instant and effortless draw using the right hand. The user's hands are reversed in the above description for a left-handed wearer and the holster 2/pistol configuration shown in FIG. 2*b*.

Figure 9B:
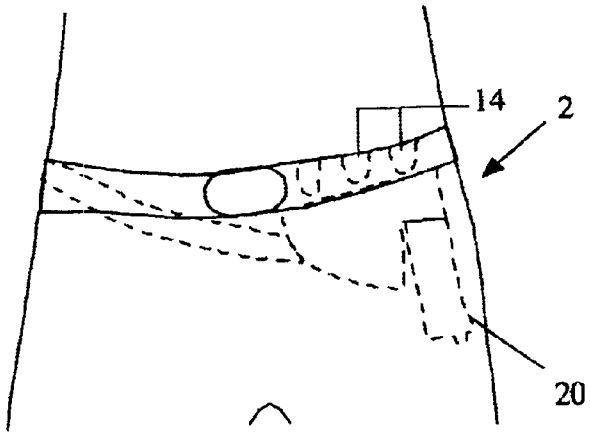

FIG. 9*b* is a close-up front perspective view further illustrating how the concealed fast-draw holster 2 is worn. The belt clips 14 are yoked around a conventional trouser belt, and the holster bracket strap 16 is tightened about the waist (all are concealed under the clothing). At all times the holster bracket strap 16 should be strapped around the waist of the user to support the assembly. Belt clips 14 ensure that the holster does not sink below the waistband level, especially with heavy pistol 20. The combination of the holster bracket clips 14 and the holster bracket strap 16 distribute the weight of the pistol 20 such that the user cannot feel the weight of the pistol being inserted in the holster bracket.

Figure 10:
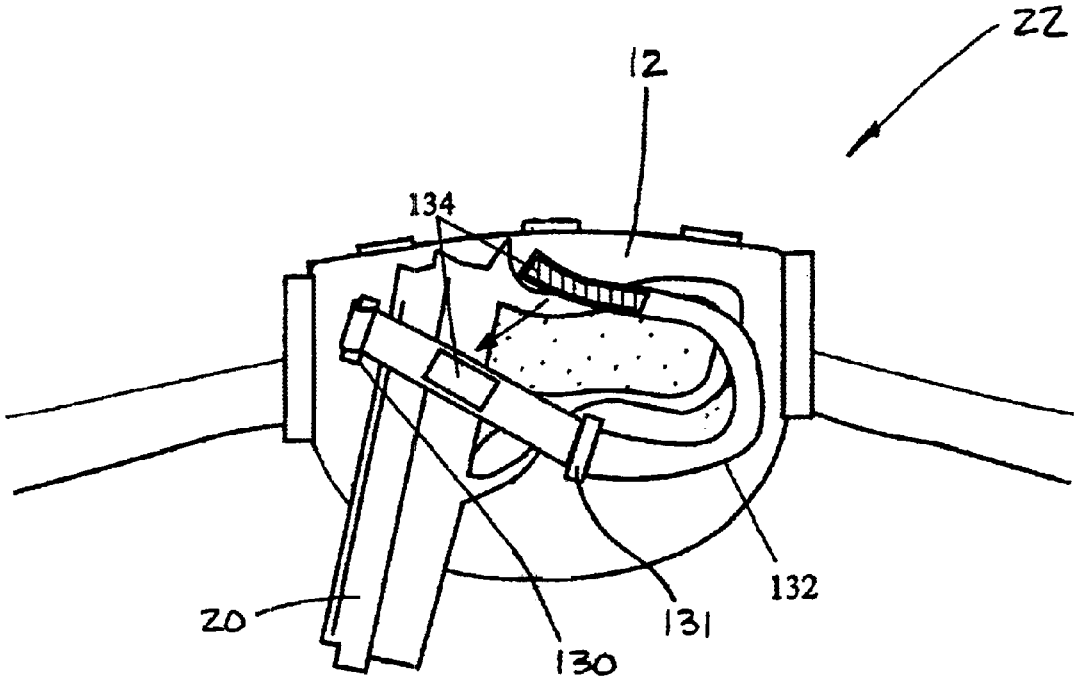
FIG. 10 is a rear perspective view of an alternative embodiment of the concealed fast-draw holster 22.
Figure 11:
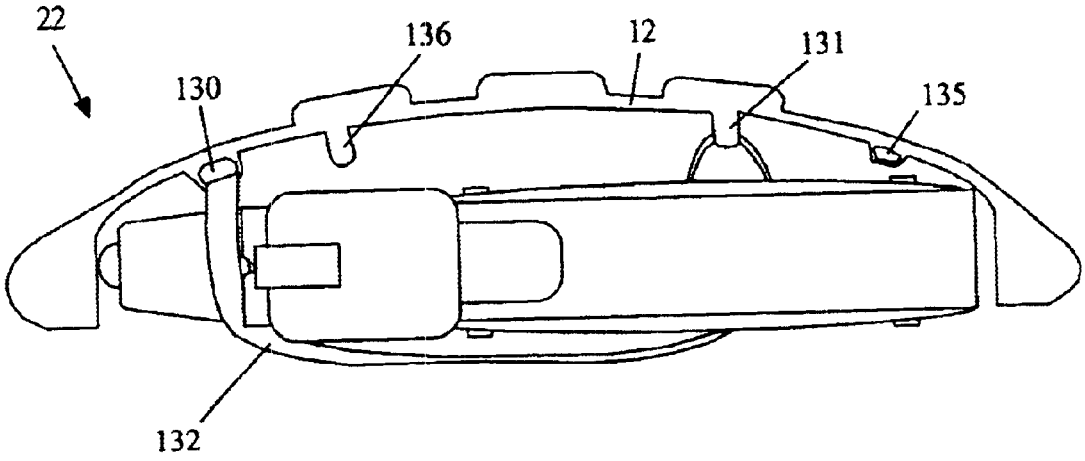
FIG. 11 is a top perspective view of the concealed fast-draw holster 22 embodiment of FIG. 10 illustrating how a pistol sits inside.

FIGS. 10 and 11 are, respectively, rear and top perspective views of an alternative molded embodiment of the concealed fast-draw holster 22 illustrating how a pistol 20 sits inside. The major components are substantially the same as with the quick-draw holster 2 of FIGS. 1–2*b* except that the seating clip 10 is replaced by a series of hitch-posts 130, 131, 135, 136 (hitch-posts 135, 136 are obscured by the pistol 20 in FIG. 10) which may be integrally formed with the holster bracket 12. For a right-handed wearer of holster 22, a strap 132 is attached to hitch-post 130 and is inserted through hitch-post 131 as shown. The strap 132 is equipped with mating hook and loop fastening pads 134 as shown to allow the strap 132 to be doubled back and fastened upon itself around the pistol 20. Hitch-post 130 is positioned such that it serves as the forward contact point for the pistol 20 (see contact point A of FIG. 7). Strap 132 extends between the hitch-posts 130, 131 and wraps around the pistol 20. Just as before, this firmly seats the pistol 20 in the illustrated slightly angled position and yet keeps the pistol 20 free for upward disengagement. The strap 132 passes approximately one inch below the rear sight of the pistol 20 towards above the hammer to make sure that the pistol 20 does not fall.

As appreciated by those skilled in the art, a left-handed wearer attaches strap 132 to hitch-post 135 before inserting it through hitch-post 136 to hold the pistol 20 in a position similar to that shown in FIGS. 2*b* and 8.

Effectively, the same result as with the embodiment of FIGS. 10 and 11 can be accomplished by replacing each hitch-post 130, 131, 135, 136 with a pair of parallel slots cut through holster bracket 12 and running parallel to the hitch-posts 130, 131, 135, 136. This way, rather than looping the strap 132 around the hitch-posts, strap 132 is looped out one slot and back in the next.

Figure 12:
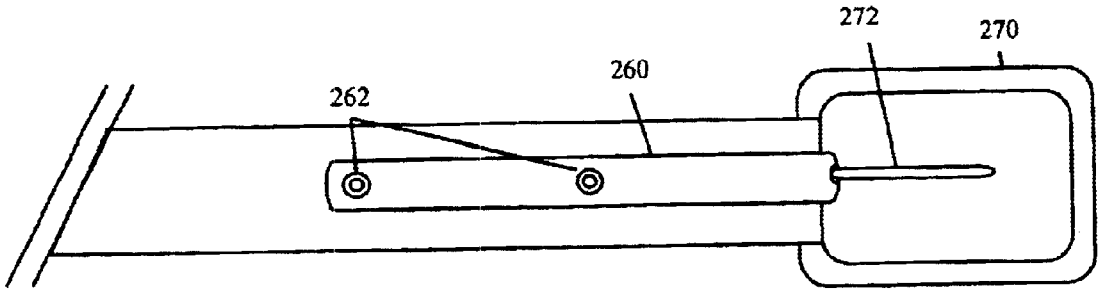
FIG. 12 is a rear side perspective view of a custom belt 270 that eliminates the need for the separate waist strap 16 in the above-described embodiments.

FIG. 12 is a rear side perspective view of a custom belt 270 that can be worn as any other belt by the user, but which includes an inner harness 260. The harness 260 may be retrofit to substantially any conventional belt, and it comprises a thin leather strip with an eye at one end for insertion around the belt buckle. The harness strip 260 is then riveted to the backside of the belt 270 at spaced intervals 262 as shown. Given this configuration, the belt clips 14 of the above-described embodiments may be inserted down through the spaced intervals 262, and the entire holster 2 is held securely in place. It is noteworthy that the belt 270 with harness strip 260 will not eliminate the need for holster bracket strap 16. The attachment of the holster bracket strap 16 is important, and the device is even useable without belt clips 14 so long as strap 16 is secure. However, belt clips 14 ensure that the holster bracket 12 does not sink below the trouser waistband during heavy physical movements (otherwise, if the holster bracket 12 sinks too far below the trouser waistband, a probability of snagging will occur). Use of both the holster bracket clips 14 and optional harness strip 260 is recommended for very heavy pistols.

Figure 13:
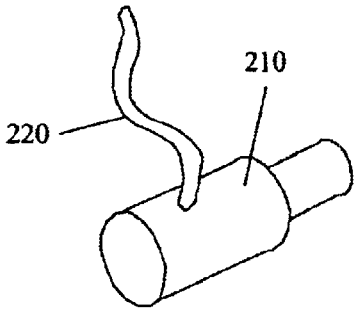
FIGS. 13–15 are, respectively, a perspective view, side view and front view of an optional plastic plug 210 for insertion in the tip of a short barreled pistol.
Figure 14:
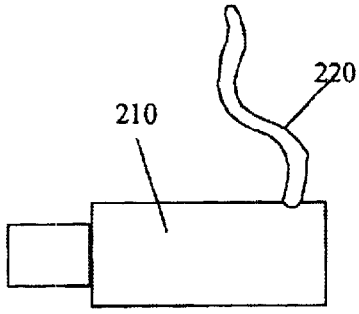
Figure 15:
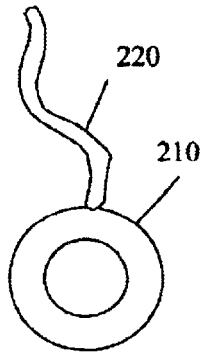

FIGS. 13–15 are, respectively, a perspective view, side view and front view of an optional plastic plug 210 for insertion in the tip of a short barreled pistol 20. Plug 210 extends the length of the barrel and helps the user to push the pistol barrel upward in the case of shorter barrels such as the Glock 26 or the Glock 27 pistol. The plug 210 is a simple two-tier plastic cylinder sized to fit the barrel. Plug 210 has an elastic tether 220 by which it can be attached to any of the foregoing holster brackets 12. After the pistol 20 is drawn, the plug 210 simply dangles below the holster bracket 12.

Figure 16:
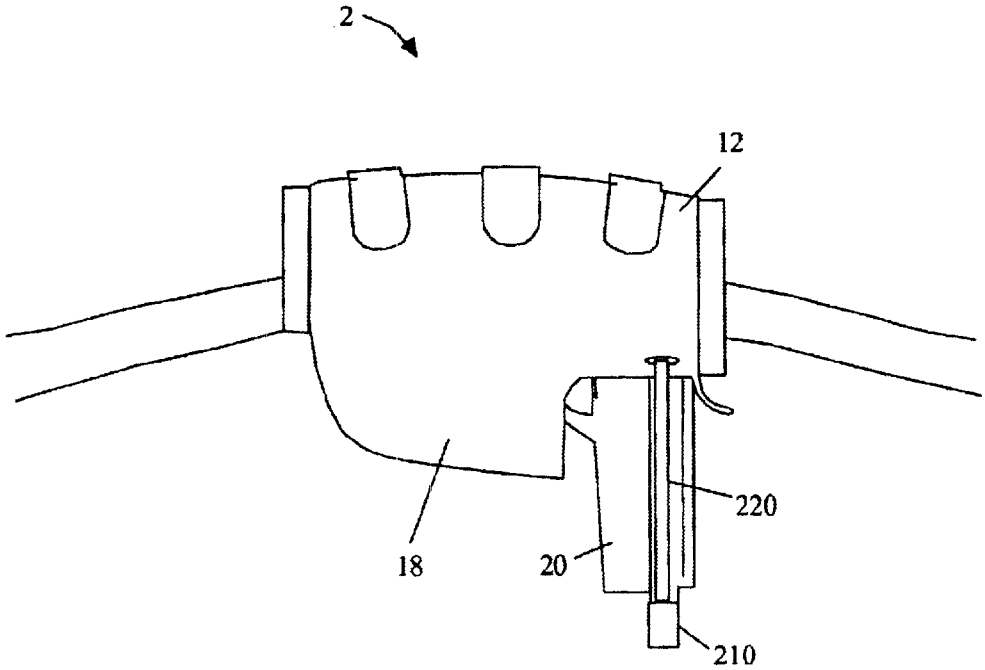
FIG. 16 is a perspective front view of the optional plastic plug 210 of FIGS. 13–15 inserted in the barrel.

FIG. 16 is a perspective front view of the optional plastic plug 210 inserted in the barrel as an extension in order to help the user to push the pistol barrel upward. An elastic tether 220 is attached between the plug 210 and the apron 18 so that when the pistol is pushed upward the plug 210 will remain behind and dangle from the apron 18. The elastic tether 220 should be sized to stretch when plug 210 is inserted into the gun. This ensures that the plug 210 will not fall out or otherwise move during body movement of the user.

Given any of the foregoing embodiments and optional accessories for use therewith, the holster does not compromise between accessibility and full-concealment, permitting instant accessibility to facilitate a quick-draw for either a right-handed or left-handed user. The key features are a contoured holster bracket that conforms to the curve of the waist, and an internal supporting seat/retainer, strap, stitching or the like. Given this combination the pistol, when pushed upward, does not snag at the trouser belt or at any other obstruction inside the trouser waistband. The curve of the bracket reduces friction on the pistol when pushed upward, and it conceals also the form of the pistol making the bracket conform to the contour of the body. Both holster and pistol can be worn comfortably and securely over a prolong period of time. Moreover, the device can easily and economically be made using a variety of economical manufacturing processes (molding, metal stamping, etc.) using a variety of alternative economical materials (plastic, metal, leather, etc.).

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A concealed holster, comprising:

a holster bracket including an arcuate panel generally conforming to the curve of the body at the abdomen, and a pair of laterally-spaced flanges for lifting the arcuate panel outward from the body, thereby introducing a clearance therebeneath;

a pistol seating strap extended between opposing points inwardly of said arcuate panel for harnessing a pistol therein within the confines of the flanges, panel and user's body;

wherein said holster is adapted to be worn under the trousers at the abdomen and the pistol is dislodged by pressing up on its barrel with one hand and drawn with the other hand.

2. The concealed holster according to claim 1, wherein said pistol seating strap is anchored at both ends by spaced C-rings protruding inward from the arcuate panel.

3. The concealed holster according to claim 1, wherein said pistol seating strap is anchored at both ends by insertion into and out from spaced pairs of parallel notches in the arcuate panel.

4. The concealed holster according to claim 1, further comprising a plastic plug tethered to said holster bracket and sized to fit inside the pistol barrel as an extension in order to help a user to push the pistol barrel upward.

5. A concealed holster, comprising:

an arcuate front panel generally conforming to the curve of the body at the abdomen;

a pistol seating ridge secured at one end to said front panel;

a back panel secured to another end of said pistol seating ridge thereby forming a compartment, defined by said arcuate front panel, said back panel and a user's body, for supporting a pistol by its trigger guard therein;

wherein the front and back panels are spaced apart by said seating ridge; and wherein said holster is adapted to be worn under the trousers at the abdomen and the pistol is dislodged by pressing up on its barrel with one hand and drawn with the other hand.

* * * * *